US011919121B2

(12) United States Patent
Cherian et al.

(10) Patent No.: US 11,919,121 B2
(45) Date of Patent: Mar. 5, 2024

(54) CONTROL OF PROCESSING PARAMETERS DURING SUBSTRATE POLISHING USING CONSTRAINED COST FUNCTION

(71) Applicant: Applied Materials, Inc., Santa Clara, CA (US)

(72) Inventors: Benjamin Cherian, San Jose, CA (US); Sivakumar Dhandapani, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/683,049

(22) Filed: Feb. 28, 2022

(65) Prior Publication Data

US 2022/0281054 A1 Sep. 8, 2022

Related U.S. Application Data

(60) Provisional application No. 63/157,508, filed on Mar. 5, 2021.

(51) Int. Cl.
*B24B 37/005* (2012.01)

(52) U.S. Cl.
CPC ..... *B24B 37/005* (2013.01)

(58) Field of Classification Search
CPC ..... B24B 37/005; B24B 37/013; B24B 37/04; B24B 37/042; B24B 37/10; B24B 37/105; B24B 49/006; B24B 49/16; B24B 49/02; B24B 49/04; B24B 49/05; B24B 49/10; B24B 49/105; B24B 49/12; B24B 7/228; G05D 5/03; H01L 21/67092; H01L 21/67253

(Continued)

(56) References Cited

U.S. PATENT DOCUMENTS 5,888,120 A 3/1999 Doran
6,439,964 B1 8/2002 Prehbu et al.
(Continued)

FOREIGN PATENT DOCUMENTS

CN 1554118 12/2004
CN 1602546 3/2005
(Continued)

OTHER PUBLICATIONS

English translation of CN 100577361C (Year: 2010).*
(Continued)

*Primary Examiner* — Joel D Crandall
*Assistant Examiner* — Sukwoo James Chang
(74) *Attorney, Agent, or Firm* — Fish & Richardson P.C.

(57) ABSTRACT

Controlling a polishing system includes receiving from an in-situ monitoring system, for each region of a plurality of regions on a substrate being processed by the polishing system, a sequence of characterizing values for the region. For each region, a polishing rate is determined for the region, and an adjustment is calculated for at least one processing parameter. Calculation of the adjustment includes minimizing a cost function that includes, for each region, a difference between a current characterizing value or an expected characterizing value at an expected endpoint time and a target characterizing value for the region, and optimization of the cost function is subject to at least one constraint.

20 Claims, 5 Drawing Sheets

(58) Field of Classification Search
USPC ..... 451/5, 11, 288, 41
See application file for complete search history.

(56) References Cited

U.S. PATENT DOCUMENTS

| | | | |
|---|---|---|---|
| 6,540,591 | B1 | 4/2003 | Pasadyn et al. |
| 6,544,103 | B1 | 4/2003 | Korovin |
| 6,932,671 | B1 | 8/2005 | Korovin et al. |
| 7,115,017 | B1 | 10/2006 | Laursen et al. |
| 8,774,958 | B2 | 7/2014 | Zhang et al. |
| 9,213,340 | B2 | 12/2015 | Zhang et al. |
| 9,490,186 | B2 | 11/2016 | Benvegnu et al. |
| 10,493,590 | B2 | 12/2019 | Zhang et al. |
| 2002/0193899 | A1 | 12/2002 | Shanmugasundram et al. |
| 2004/0023606 | A1 | 2/2004 | Wang et al. |
| 2005/0070205 | A1 | 3/2005 | Korovin et al. |
| 2006/0009127 | A1 | 1/2006 | Sakurai et al. |
| 2006/0106479 | A1 | 5/2006 | de Roover et al. |
| 2007/0102116 | A1 | 5/2007 | Shanmugasundram et al. |
| 2007/0224915 | A1* | 9/2007 | David ..... B24B 37/013 451/6 |
| 2007/0243795 | A1 | 10/2007 | Kobayashi et al. |
| 2008/0051009 | A1 | 2/2008 | Wang et al. |
| 2008/0119119 | A1 | 5/2008 | Zuniga et al. |
| 2008/0139087 | A1 | 6/2008 | Togawa et al. |
| 2010/0029177 | A1 | 2/2010 | Kobayashi et al. |
| 2010/0217430 | A1 | 8/2010 | David et al. |
| 2011/0256805 | A1 | 10/2011 | David et al. |
| 2012/0034845 | A1* | 2/2012 | Hu ..... B24B 37/042 451/6 |
| 2012/0100781 | A1* | 4/2012 | Zhang ..... B24B 49/12 451/6 |
| 2012/0277897 | A1 | 11/2012 | Zhang et al. |
| 2013/0204424 | A1 | 8/2013 | David et al. |
| 2013/0237128 | A1 | 9/2013 | David et al. |
| 2013/0273812 | A1 | 10/2013 | Qian et al. |
| 2013/0280827 | A1 | 10/2013 | Benvegnu et al. |
| 2016/0372388 | A1 | 12/2016 | Benvegnu et al. |
| 2018/0150052 | A1 | 5/2018 | Cherian et al. |
| 2022/0281055 | A1 | 9/2022 | Cherian et al. |
| 2022/0281056 | A1 | 9/2022 | Cherian et al. |

FOREIGN PATENT DOCUMENTS

| | | | |
|---|---|---|---|
| CN | 100577361 C | * 1/2010 | ..... B24B 37/04 |
| CN | 104583712 | 4/2015 | |
| CN | 105745743 | 7/2016 | |
| CN | 106062933 | 10/2016 | |
| CN | 109844923 | 6/2019 | |
| CN | 110223936 | 9/2019 | |
| CN | 111863613 | 10/2020 | |
| JP | 2006-043873 | 2/2006 | |
| TW | 200607604 | 3/2006 | |
| TW | 200822204 | 5/2008 | |
| TW | I322059 | 3/2010 | |
| WO | WO 2008/032753 | 3/2008 | |
| WO | WO 2018/132424 | 7/2018 | |

OTHER PUBLICATIONS

Bae et al., "Effect of Retainer Pressure on Removal Profile and Stress Distribution in Oxide CMP," International Conference on Planarization/CMP Technology, Fukuoka, Nov. 19-21, 2009, pp. 345-349.

International Search Report and Written Opinion in International Appln. No. PCT/US2022/018161, dated Jun. 14, 2022, 8 pages.

English translation of CN105745743A (Year: 2016), 20 pages.

Vandebogert, "Method of Quadratic Interpolation," University of South Carolina, Sep. 3, 2017, 22 pages.

Office Action in Chinese Appln. No. 202210212981.0, dated Jul. 28, 2023, 12 pages (with English translation).

* cited by examiner

CONTROL OF PROCESSING PARAMETERS DURING SUBSTRATE POLISHING USING CONSTRAINED COST FUNCTION

CROSS-REFERENCE TO RELATED APPLICATIONS

This application claims the benefit of priority to U.S. Application No. 63/157,508, filed on Mar. 5, 2021, the contents of which are hereby incorporated by reference.

TECHNICAL FIELD

The present disclosure relates generally to control of processing parameters during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer, e.g., until the top surface of a patterned layer is exposed or a predetermined thickness remains over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad with a durable roughened surface. The carrier head provides a controllable load on the substrate to push it against the polishing pad. A polishing liquid, such as a slurry with abrasive particles, is typically supplied to the surface of the polishing pad.

One problem in CMP is using an appropriate polishing rate to achieve a desirable profile, e.g., a substrate layer that has been planarized to a desired flatness or thickness, or a desired amount of material has been removed. Variations in the initial thickness of a substrate layer, the slurry composition, the polishing pad condition, the relative speed between the polishing pad and a substrate, and the load on a substrate can cause variations in the material removal rate across a substrate, and from substrate to substrate.

SUMMARY

A computer program product, method, or polishing system having a controller operates to receive from an in-situ monitoring system, for each region of a plurality of regions on a substrate being processed by the polishing system, a sequence of characterizing values for the region. For each region, a polishing rate is determined for the region, and an adjustment is calculated for at least one processing parameter.

In one aspect, calculation of the adjustment includes minimizing a cost function that includes, for each region, i) a difference between a current characterizing value or an expected characterizing value at an expected endpoint time and a target characterizing value for the region, and ii) a plurality of a projected future pressure changes over time for the region and/or a plurality of differences between projected future pressures over time and a baseline pressure for the region.

In another aspect, calculation of the adjustment includes minimizing a cost function that includes, for each region, a difference between a current characterizing value or an expected characterizing value at an expected endpoint time and a target characterizing value for the region, and minimization of the cost function is subject to at least one constraint.

In another aspect, for each of a plurality of parameter update times, an adjustment is calculated for at least one processing parameter, where calculation of the adjustment for a particular parameter update time from the plurality of parameter update times includes calculation of expected future parameter changes for at least two future parameter update times subsequent to the particular parameter update time.

Implementations can include one or more of the following potential advantages.

Control inputs can be "optimized" for multiple objectives simultaneously, including one or more objectives other than simply minimizing a difference between a projected thickness and a target thickness at future time. For example, the objectives can include reducing pressure changes and/or minimizing departure from a baseline pressure. This permits evolution of the control inputs in manner that can avoid underdamped or overdamped behavior.

The optimization can be performed when the inputs affect overlapping regions on the substrate. This permits control of the polishing profile with improved spatial resolution, and can reduce within-wafer non-uniformity (WIWNU) and reduce edge exclusion.

The optimization can be performed under a variety of constraints, e.g., general linear inequality constraints. Where the control inputs are pressures in chambers in a carrier head, this permits limiting pressure differentials between adjacent chambers, which can provide for smoother pressure transitions across polishing zone boundaries and thus reduce within-wafer non-uniformity (WIWNU).

The optimization can be performed in real time, i.e., as data is collected during polishing and sufficiently quickly to permit modification of control inputs at a sufficiently high frequency, e.g., every 2-20 seconds, to permit multiple adjustments over the polishing process. This can permit the polishing process to reach the target thickness reliably while also balancing needs for other objectives.

It should be understood that optimization (or minimization) is subject to practical constraints, e.g., the optimization algorithm may be subject to available computational processing power and time.

The details of one or more embodiments set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Polishing parameters, e.g., the pressure in different chambers in a carrier head and the thus the pressure on different zones on the substrate, can be controlled in order to improve polishing uniformity or to make a substrate be polished closer to a target profile. Control algorithms have been proposed that determine the polishing rate in one zone based on multiple polishing parameters. For example, the polishing rate in a zone can be determined both by the pressure of the chamber directly over the zone as well as the pressure in chambers over adjacent zones. However, when taking into account the contribution from multiple parameters, the control algorithms might only be accurate under certain constraints between the parameters. For example, the impact on polishing rate on one zone from the pressure in the chamber for an adjacent zone might only be accurate if the pressure difference between the zones is small, e.g., less than 2 psi. Conventional controllers do not properly take into account such general linear inequality constraints. On the one hand, if the constraints are ignored, then the algorithm may select polishing parameter values that lead to unexpected results or actually increase non-uniformity. However, if the parameters are simply clipped to be set at a maximum or minimum value, then polishing will not proceed as computed by the algorithm.

Another issue that can arise in control of the polishing parameters is underdamped or overdamped behavior. For example, for underdamping, the control algorithm can set a polishing parameter at a value that overcompensates for variation from the target, and thus results in oscillation of the parameter values. On the other hand, for overdamping, the control algorithm can set a polishing parameter at a value that undercompensates for variation from the target, which can result in the substrate not actually reaching the target.

Either or both of these issues can be addressed by a control algorithm that conducts constrained optimization of a general cost function that includes computation of future parameter values and the resulting estimated polishing profile resulting from the future parameter. During the polishing process of the substrate, the processing parameters for each zone can be calculated in real-time using an approach that includes various constraints on the control inputs, i.e., the controllable polishing parameters such as applied chamber pressures, platen or carrier head rotation rates, etc.

Figure 1:
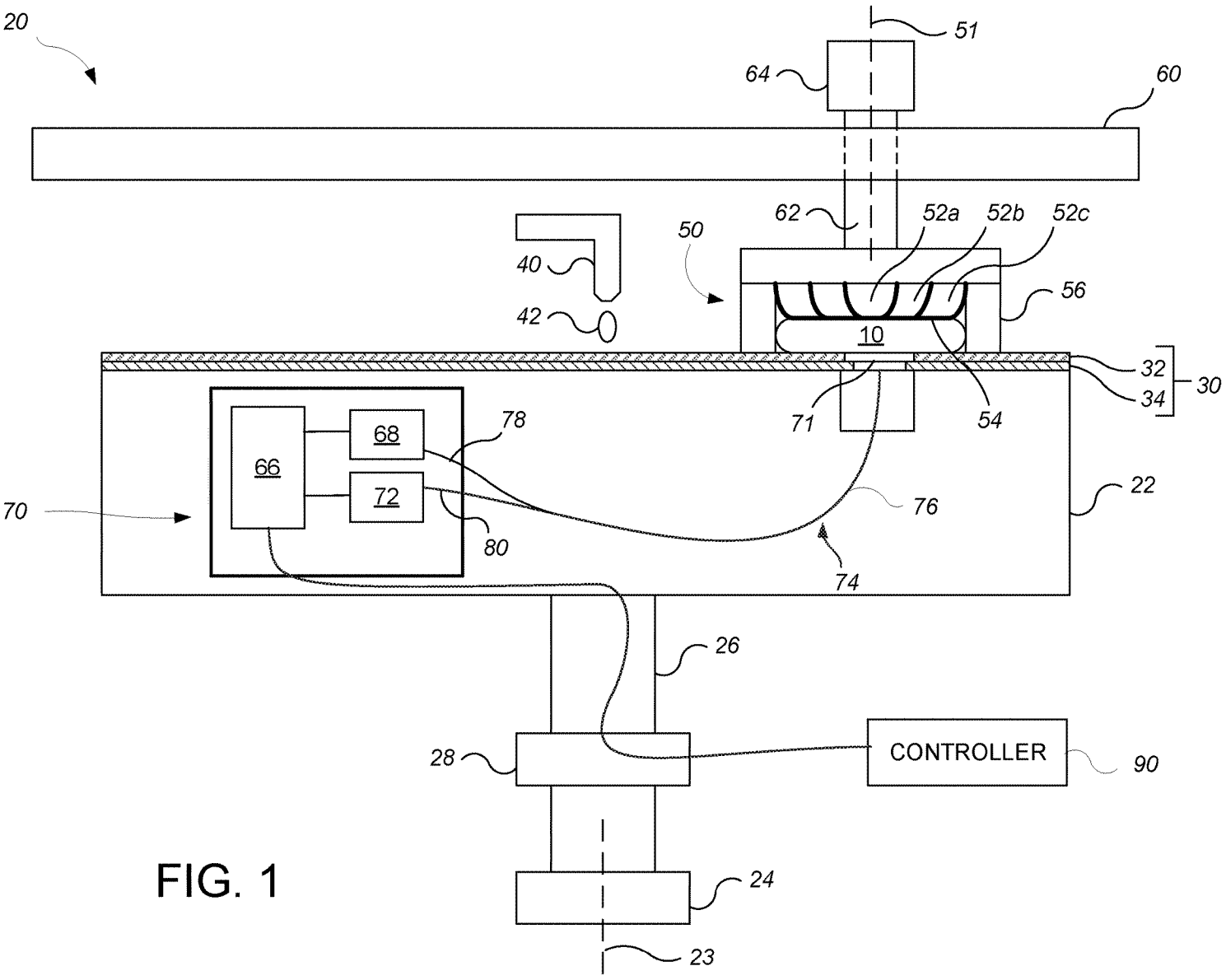
FIG. 1 illustrates a schematic cross-sectional view of an example of a polishing apparatus.

FIG. 1 illustrates an example of a polishing apparatus 20. The polishing apparatus 20 can include a rotatable disk-shaped platen 22 on which a polishing pad 30 is situated. The platen is operable to rotate about an axis 23. For example, a motor 24 can turn a drive shaft 26 to rotate the platen 22. The polishing pad 30 can be detachably secured to the platen 22, for example, by a layer of adhesive. The polishing pad 30 can be a two-layer polishing pad with an outer polishing layer 32 and a softer backing layer 34.

The polishing apparatus 20 can include a polishing liquid supply port 40 to dispense a polishing liquid 42, such as an abrasive slurry, onto the polishing pad 30. The polishing apparatus 20 can also include a polishing pad conditioning disc to abrade the polishing pad 30 to maintain the polishing pad 30 in a consistent abrasive state.

A carrier head 50 is operable to hold a substrate 10 against the polishing pad 30. The carrier head 50 can include a plurality of independently controllable pressurized chambers, e.g., three chambers 52*a*-52*c*, which can apply independently controllable pressures to associated zones 148*a*-148*c* on the substrate 10 (see FIG. 2).

Figure 2:
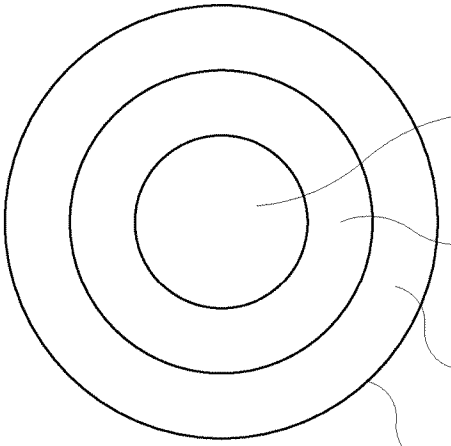
FIG. 2 illustrates a schematic top view of a substrate having multiple zones.

Referring to FIG. 2, the center zone 148*a* can be substantially circular, and the remaining zones 148*b*-148*c* can be concentric annular zones around the center zone 148*a*.

Returning to FIG. 1, the chambers 52*a*-52*c* can be defined by a flexible membrane 54 having a bottom surface to which the substrate 10 is mounted. The carrier head 50 can also include a retaining ring 56 to retain the substrate 10 below the flexible membrane 54. Although only three chambers are illustrated in FIG. 1 for ease of illustration, there could be two chambers, or four or more chambers, e.g., five chambers. In addition, other mechanisms to adjust the pressure applied to the substrate, e.g., piezoelectric actuators, could be used in the carrier head 50.

Each carrier head 50 is suspended from a support structure 60, e.g., a carousel or track, and is connected by a drive shaft 62 to a carrier head rotation motor 64 so that the carrier head can rotate about an axis 51. Optionally each carrier head 50 can oscillate laterally, e.g., on sliders on the carousel, by motion along the track, or by rotational oscillation of the carousel itself. In operation, the platen 22 is rotated about its central axis 23, and the carrier head 50 is rotated about its central axis 51 and translated laterally across the top surface of the polishing pad 30.

While only one carrier head 50 is shown, more carrier heads can be provided to hold additional substrates so that the surface area of polishing pad 30 may be used efficiently.

The polishing apparatus also includes an in-situ monitoring system 70, which can be used to determine whether to adjust a polishing rate or an adjustment for the polishing rate as discussed below. The in-situ monitoring system 70 can include an optical monitoring system, e.g., a spectrographic monitoring system, or an eddy current monitoring system.

In one embodiment, the monitoring system 70 is an optical monitoring system. An optical access through the polishing pad is provided by including an aperture (i.e., a hole that runs through the pad) or a solid window 71. The solid window 71 can be secured to the polishing pad 30, e.g., as a plug that fills an aperture in the polishing pad, e.g., is molded to or adhesively secured to the polishing pad, although in some implementations the solid window can be supported on the platen 22 and project into an aperture in the polishing pad.

The optical monitoring system 70 can include a light source 68, a light detector 72, and circuitry 66 for sending and receiving signals between a remote controller 90, e.g., a computer, and the light source 68 and light detector 72. One or more optical fibers can be used to transmit the light from the light source 68 to the optical access in the polishing pad, and to transmit light reflected from the substrate 10 to the detector 72. For example, a bifurcated optical fiber 74 can be used to transmit the light from the light source 68 to the substrate 10 and back to the detector 72. The bifurcated optical fiber 74 can include a trunk 76 positioned in proximity to the optical access, and two branches 78 and 80 connected to the light source 68 and detector 72, respectively.

In some implementations, the top surface of the platen can include a recess into which is fit an optical head that holds one end of the trunk of the bifurcated fiber. The optical head can include a mechanism to adjust the vertical distance between the top of the trunk and the solid window.

The output of the circuitry 66 can be a digital electronic signal that passes through a rotary coupler, e.g., a slip ring, in the drive shaft 26 to the controller 90 for the optical monitoring system. Similarly, the light source can be turned on or off in response to control commands in digital electronic signals that pass from the controller 90 through the rotary coupler to the optical monitoring system 70. Alternatively, the circuitry 66 could communicate with the controller 90 by a wireless signal.

The light source 68 can be operable to emit white light. In one implementation, the white light emitted includes light having wavelengths of 200-800 nanometers. A suitable light source is a xenon lamp or a xenon mercury lamp.

The light detector 72 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency).

As noted above, the light source 68 and light detector 72 can be connected to a computing device, e.g., the controller 90, operable to control their operation and receive their signals. The computing device can include a microprocessor situated near the polishing apparatus, e.g., a programmable computer. With respect to control, the computing device can, for example, synchronize activation of the light source with the rotation of the platen 22.

In some implementations, the light source 68 and detector 72 of the in-situ monitoring system 70 are installed in and rotate with the platen 22. In this case, the motion of the platen will cause the sensor to scan across each substrate. In particular, as the platen 22 rotates, the controller 90 can cause the light source 68 to emit a series of flashes starting just before and ending just after each substrate 10 passes over the optical access. Alternatively, the computing device can cause the light source 68 to emit light continuously starting just before and ending just after each substrate 10 passes over the optical access. In either case, the signal from the detector can be used to modify control inputs at a sufficiently high frequency, e.g., every 2-20 seconds, to permit multiple adjustments over the polishing process.

In operation, the controller 90 can receive, for example, a signal that carries information describing a spectrum of the light received by the light detector for a particular flash of the light source or time frame of the detector. Thus, this spectrum is a spectrum measured in-situ during polishing.

Figure 3A:
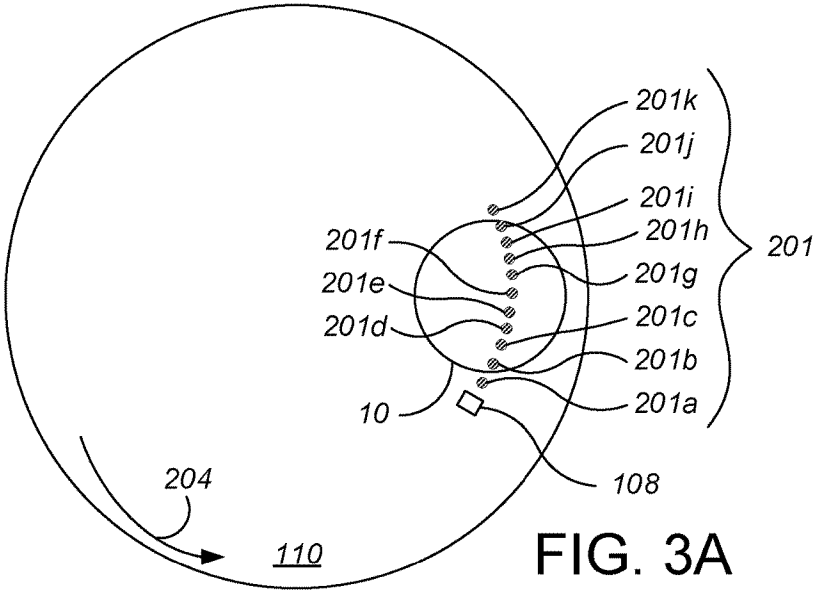
FIG. 3A illustrates a top view of a polishing pad and shows regions where in-situ measurements are taken on a substrate.

As shown by in FIG. 3A, if the detector is installed in the platen, due to the rotation of the platen (shown by arrow 204), as the window 108 travels below one carrier head (e.g., the carrier head holding the substrate 10), the optical monitoring system making spectra measurements at a sampling frequency will cause the spectra measurements to be taken at locations 201 in an arc that traverses the substrate 10. For example, each of points 201*a*-201*k* represents a location of a spectrum measurement by the monitoring system of the substrate 10 (the number of points is illustrative; more or fewer measurements can be taken than illustrated, depending on the sampling frequency). As shown, over one rotation of the platen, spectra are obtained from different radii on the substrate 10. That is, some spectra are obtained from locations closer to the center of the substrate 10 and some are closer to the edge. Thus, for any given scan of the optical monitoring system across a substrate 10 based on timing, motor encoder information, and optical detection of the edge of the substrate and/or retaining ring, the controller 90 can calculate the radial position (relative to the center of the substrate 10) for each measured spectrum from the scan. The polishing system can also include a rotary position sensor, e.g., a flange attached to an edge of the platen that will pass through a stationary optical interrupter, to provide additional data for determination of the position on the substrate of the measured spectrum. The controller 90 can thus associate the various measured spectra with the zones 148*a*-148*c* (see FIG. 2) on the substrate 10. In some implementations, the time of measurement of the spectrum can be used as a substitute for the exact calculation of the radial position.

Figure 3B:
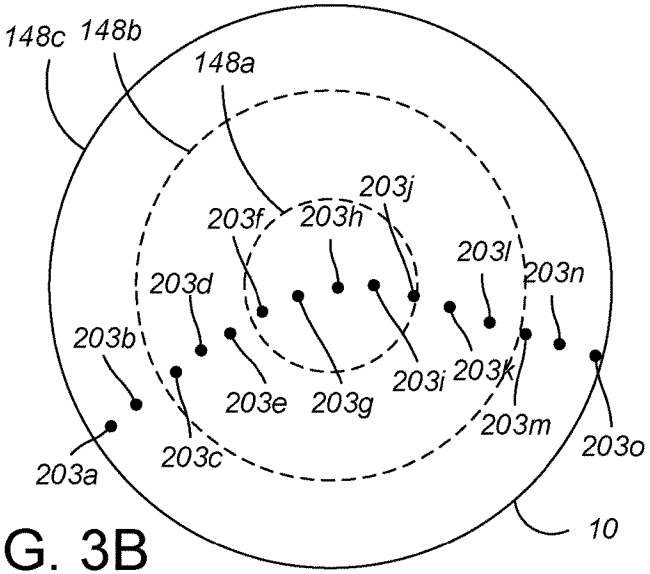
FIG. 3B illustrates a schematic top view of a distribution of multiple regions where in-situ measurements are taken relative to multiple zones of a substrate.

As an example, referring to FIG. 3B, in one rotation of the platen, spectra corresponding to different regions 203*a*-203*o* are collected by the light detector 72. Based on the radial positions of the regions 203*a*-203*o*, five spectra collected at regions 203*a*-203*b* and 203*m*-203*o* are associated with the outer zone 148*c*; five spectra collected at regions 203*c*-203*e* and 203*k*-2031 are associated with the middle zone 148*b*; and five spectra collected at regions 203*f*-203*j* are associated with the inner zone 148*a*. Although this example shows that each zone is associated with the same number of spectra, the zones may also be associated with different numbers of spectra based on the in-situ measurements. The number of spectra associated with each zone may change from one rotation of the platen to another. Of course, the numbers of regions given above are simply illustrative, as the actual number of spectra associated with each zone will depend at least on the sampling rate, the rotation rate of the platen, and the radial width of each zone.

Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

For each measured spectrum, the controller 90 can calculate a characterizing value. The characterizing value is typically the thickness of the outer layer, but can be a related characteristic such as thickness removed. In addition, the characterizing value can be a physical property other than thickness, e.g., metal line resistance. In addition, the characterizing value can be a more generic representation of the progress of the substrate through the polishing process, e.g., an index value representing the time or number of platen rotations at which the spectrum would be expected to be observed in a polishing process that follows a predetermined progress.

One technique to calculate a characterizing value is for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for the matching reference spectrum, a characterizing value can be generated. This technique is described in U.S. Patent Publication No. 2010-0217430.

Another technique is to fit an optical model to the measured spectrum. In particular, a parameter of the optical model is optimized to provide the best fit of the model to the measured spectrum. The parameter value generated for the measured spectrum generates the characterizing value. This technique is described in U.S. Patent Application No. 2013-0237128. Possible input parameters of the optical model can include the thickness, index of refraction and/or extinction coefficient of each of the layers, spacing and/or width of a repeating feature on the substrate.

Calculation of a difference between the output spectrum and the measured spectrum can be a sum of absolute differences between the measured spectrum and the output spectrum across the spectra, or a sum of squared differences between the measured spectrum and the reference spectrum. Other techniques for calculating the difference are possible, e.g., a cross-correlation between the measured spectrum and the output spectrum can be calculated.

Another technique is to analyze a characteristic of a spectral feature from the measured spectrum, e.g., a wavelength or width of a peak or valley in the measured spectrum. The wavelength or width value of the feature from the measured spectrum provides the characterizing value. This technique is described in U.S. Patent Publication No. 2011-0256805.

Another technique is to perform a Fourier transform of the measured spectrum. A position of one of the peaks from the transformed spectrum is measured. The position value generated for measured spectrum generates the characterizing value. This technique is described in U.S. Patent Publication No. 2013-0280827.

Based on the spectra measured during one rotation of the platen, multiple characterizing values can be derived based on the multiple (e.g., five in the example shown in FIG. 3B) spectra associated with each zone. For simplicity of the discussion below, we assume that the characterizing value is a thickness value (simply referred to as a "thickness" in the discussion below). However, the discussion also applies to other types of characterizing values that depend on the thickness, e.g., an index value representing the time or number of platen rotations at which the spectrum would be expected to be observed. For example, other types of characterizing values can also be used, in a similar manner or in the same manner as the thickness discussed below, in determining polishing rate adjustments during polishing processes. Similarly, the polishing rate need not be a rate of change of the thickness but can be a rate of change of the characterizing value.

For the purposes of this discussion, the thickness values directly derived from the results of the in-situ measurements are called derived thicknesses. In the example of optical monitoring, each derived thickness corresponds to a measured spectrum. The name "derived thickness(es)" is not intended to provide any meaning to such thicknesses. Instead, the name is merely chosen to distinguish these thickness values from other types of thicknesses, e.g., thicknesses obtained from other sources or from additional data processing, discussed further below. Other names can be chosen for the same purpose.

The multiple derived thicknesses for a zone may be different, e.g., due to the actual (or physical) thickness difference at different regions in the same zone, measurement error, and/or data processing error. In some implementations, within error tolerance, a so-called "measured thickness" of a zone in a given rotation of the platen may be calculated based on the multiple derived thicknesses in the given rotation. The measured thickness of a zone in a given rotation can be the average value or a median value of the multiple derived thicknesses in the given rotation. Alternatively, the measured thickness of a zone in a given rotation can be generated by fitting a function, e.g., a polynomial function, e.g., a linear function, to the multiple derived thicknesses from multiple rotations, and calculating the value of the function at the given rotation. When fitting the function, the calculation can be performed using only the derived thickness since the most recent pressure/polishing rate adjustment.

Whichever technique is used to calculate the measured "thickness", over multiple rotations of the platen, for each zone of each substrate, a sequence of measured thicknesses can be obtained over time. In some implementations, which technique to calculate the measured "thickness" can be selected by user input from an operator of the polishing apparatus through a graphical user interface, e.g., a radio button.

Pressure Control Based on the In-Situ Measurements

The controller 90 stores a desired thickness profile that is desired to be achieved at the end of a polishing process (or at the endpoint time when the polishing process stops) for a substrate. The desired thickness profile can have a uniform thickness for all zones on the substrate 10, or different thicknesses for different zones on the substrate 10. The desired thickness profile defines a relative thickness relationship of all zones of the substrate at the endpoint time.

When a substrate is being polished, the polishing rate variations between different zones of the substrate can lead to the different zones reaching their target thickness at different times. By controlling polishing parameters in accordance with an optimization algorithm, the desired thickness profile can be achieved. The processing parameters for one or more zones can be adjusted to facilitate the substrate to achieve closer endpoint conditions. "Closer endpoint conditions" means that the zones of a substrate would reach their target thickness(es) closer to the same time than without such adjustment, or that the zones of the substrates would have closer to their target thickness(es) at an endpoint time than without such adjustment. During the polishing process, the polishing parameters that control polishing in the zone (and thus the eventual thickness profile of the substrate) are calculated in real-time by optimizing, e.g., minimizing, a cost function. The optimization approach can include various constraints on the values of these polishing parameters. The optimization algorithm can use any suitable algorithms that can solve linear or nonlinear convex optimization problems (e.g., an interior-point or active-set approach) by structuring these constraints in the form of linear matrix equalities or inequalities.

The polishing rate of a substrate zone can be adjusted to a desired polishing rate by adjusting the pressure applied by a polishing head to the substrate zone. The pressure adjustment can be determined by the difference between the desired polishing rate and a current polishing rate, while also factoring in the polishing parameter constraints, such as minimum and maximum pressure constraints for the carrier head. In some implementation, calculation of the pressure adjustment for one zone takes into account effects of pressure on other zones on the polishing rate of the one zone including the overlapping zones, e.g., using a Preston matrix. During the polishing process, measured thicknesses and measured polishing rates of multiple zones can be determined in-situ for each rotation of the platen, based on the in-situ measurements of completed rotation(s). The relationship among the measured thicknesses can be compared with the relative thickness relationship and the actual polishing rates can be adjusted so that the actual (or physical) thicknesses are changed in future rotation(s) to more closely follow the relative thickness relationship. Similar to the actual thicknesses and the measured/derived thicknesses, the actual polishing rates are represented by the measured polishing rates. In one example, the actual polishing rates of certain zones can be changed by changing the pressure of the corresponding chambers and the amount of pressure changes can be derived from the amount of polishing rates to be changed, as explained further below.

In some implementations, one zone of the substrate is selected to be a so-called reference zone. The reference zone can be chosen to be a zone that provides the most reliable in-situ thickness measurement and/or has the most reliable control over the polishing. For example, the reference zone can be a zone from which the largest number of spectra is collected from each rotation of the platen. The reference zone can be chosen by the controller or the computer based on the in-situ measurement data. The measured thickness of the reference zone can be viewed as representing the actual thickness of the reference zone at a relatively high precision. Such a measured thickness provides a reference thickness point for all other zones in the substrate, which can be called controlled zone. For example, based on the measured thickness of the reference zone in a given rotation of the platen, the desired thicknesses of the controlled zone for the given rotation of the platen can be determined based on their relative thickness relationships to the reference zone.

In some implementations, the controller and/or computer can schedule adjustments to the polishing rate(s) of the controlled zone(s). For example, the adjustment can be scheduled to occur at a predetermined rate, e.g., every given number of rotations, e.g., every 5 to 50 rotations, or every given number of seconds, e.g., every 3 to 30 seconds. In some ideal situations, the adjustment may be zero at the prescheduled adjustment time. In other implementations, the adjustments can be made at a rate determined in-situ. For example, if the measured thicknesses of different zones are vastly different from the desired thickness relationships, then the controller and/or the computer may decide to make more frequent adjustments for the polishing rates.

Figure 4A:
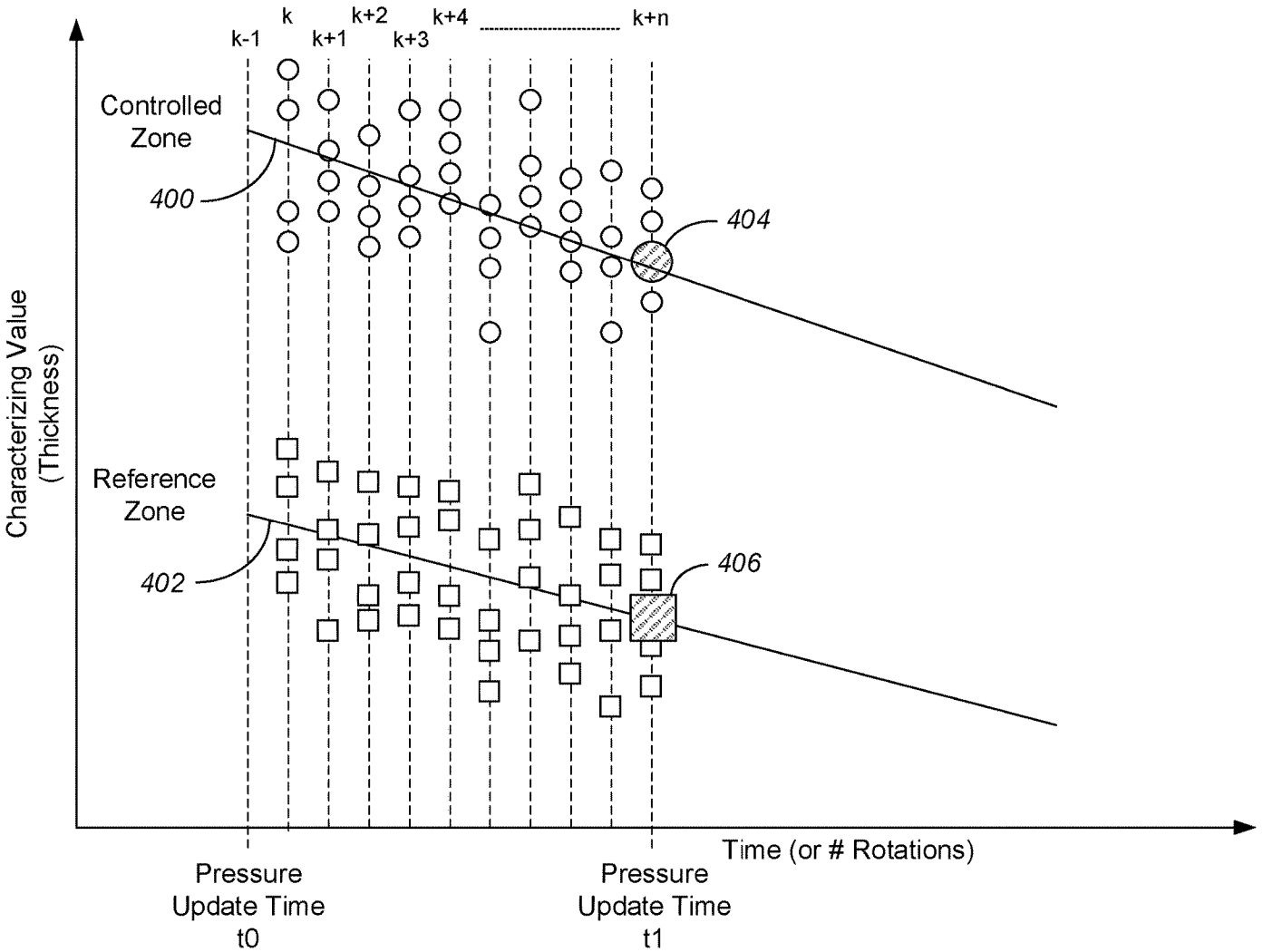
FIG. 4A is a plot of thicknesses derived from in-situ measurements for a controlled zone and a reference zone.

Referring to FIG. 4A, the derived thicknesses (or the thicknesses derived from in-situ measurements, such as optical spectra) for a reference zone and a controlled zone are plotted to facilitate the visualization of a process for adjusting the chamber pressure and the polishing rate of the controlled zone. The chamber pressure and the polishing rate of any other controlled zone can be similarly performed. The controller and/or the computer processing the data might or might not make or display the plot shown in FIG. 4A.

In particular, along the time axis (horizontal axis), two predetermined pressure update times $t_0$ and $t_1$ have been marked. The time axis can also be mapped to the number of rotations completed by the platen. The current time point of the polishing process shown in the plot is $t_1$, at which time the platen has completed k+n rotations, (n+1) of which have been completed between the two pressure update time to (exclusive) and $t_1$ (inclusive). In the example shown in the plot, n is 9, and a total of 10 rotations have been completed in the time period $t_1$-$t_0$. Of course, n could be a value other than 9, e.g., 5 or more, depending on the rate at which adjustments are performed and the rotation rate of the platen.

Figure 4B:
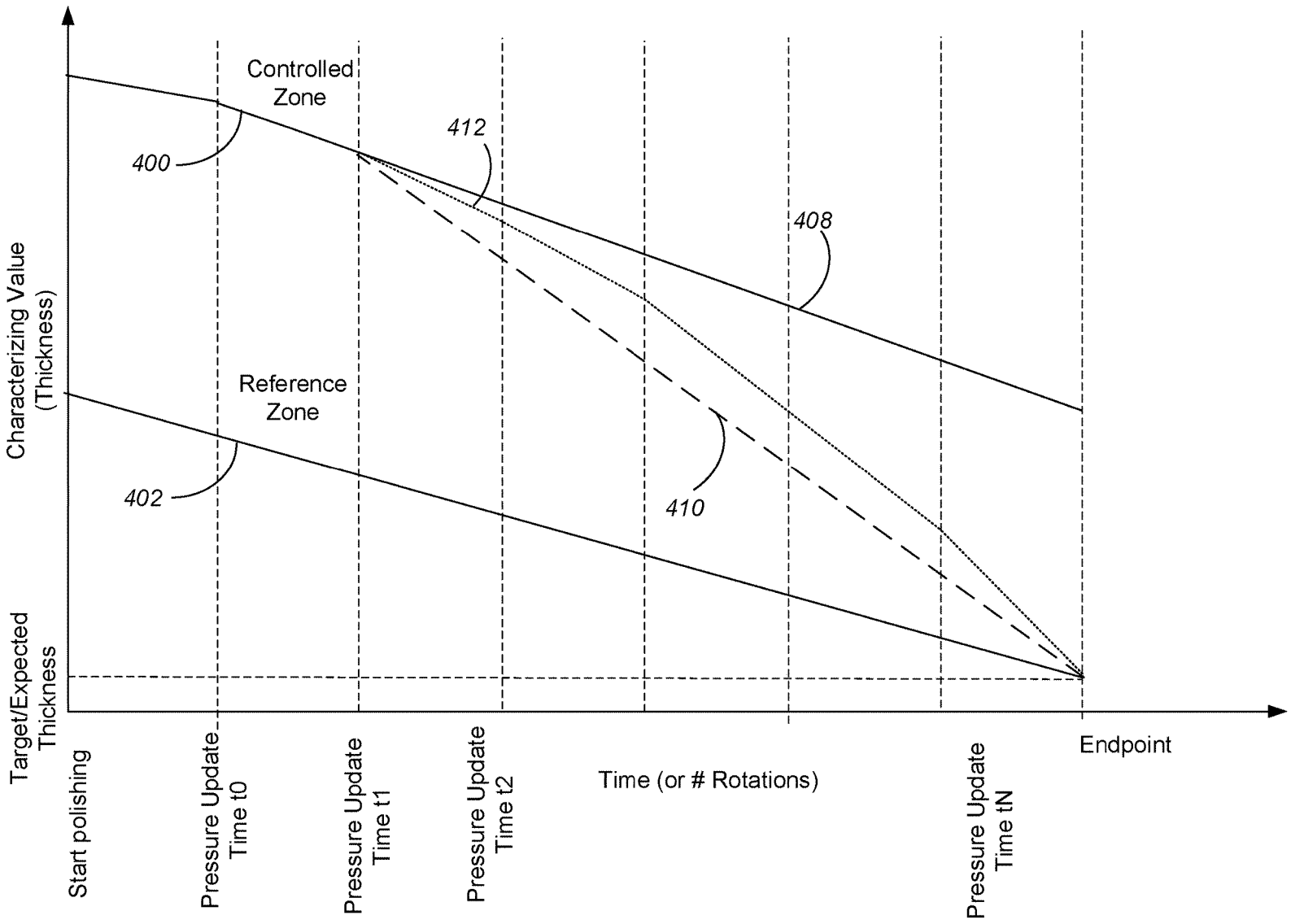
FIG. 4B is a plot illustrating projected thicknesses calculated assuming a plurality of changes over time in control inputs.

The chamber pressure adjustment and polishing rate adjustment for the controlled zone is to be determined so that during the time period $t_1$ to $t_2$ (shown in FIG. 4B), the controlled zone is polished at the adjusted polishing rate (the slope of function 412). Before the pressure update time to, zero or one or more chamber pressure/polishing rate updates might have already been performed for the controlled zone, in a manner similar to the adjustments to be determined and to be made at $t_1$. Similarly, after the pressure update time $t_1$, zero or one or more additional pressure updates might be performed, e.g., at time $t_2$, . . . $t_N$, also in a manner similar to the adjustments determined and to be made at $t_1$, until the endpoint time of the polishing process (shown in FIG. 4B).

The derived thicknesses of the controlled zone and the reference zone during the n+1 rotations of the platen in the time period $t_0$-$t_1$ are used in determining the measured thicknesses in each rotation, the measured polishing rate in each rotation, the desired polishing rate after $t_1$, the amount of adjustment to be made to the polishing rate, and therefore, the amount of chamber pressure adjustment, for the controlled zone in the time period $t_2$-$t_1$. For each rotation k, . . . k+n, the derived thicknesses of the controlled zone and the reference zone are represented by circles and squares in the plot, respectively. For example, for rotation k, four derived thicknesses are plotted for each of the controlled zone and the reference zone; for rotation k+1, four derived thicknesses are plotted for the controlled zone and three derived thicknesses are plotted for the reference zone; and so on.

Measured Thicknesses and Polishing Rates

As briefly explained previously, for each zone, the measured thickness in each rotation can be determined as the average or median value of all derived thicknesses in the rotation, or can be a fitted value. A measured polishing rate for each zone can be determined in each rotation using a function that fits the derived thicknesses of each zone.

In some implementations, a polynomial function of known order, e.g., a linear function, can be fit to all derived thicknesses of each zone between the time period $t_0$ to $t_1$. For example, the fitting can be performed using robust line fitting. In some implementations, the function is fit to less than all of the derived thicknesses, e.g., the function can be fit to the median value from each rotation. Where a least squares calculation is used for the fit, this can be termed a "least squares median fit".

Based on the fitted functions, which can be represented as a function $F_{control}$(time) or $F_{ref}$(time) for the controlled zone or the reference zone, a measured polishing rate in the $(k+i)^{th}$ rotation of the platen, where i=0, . . . , n, can be calculated as $$\frac{\partial F_{control}(\text{time})}{\partial \text{time}}\Big|_{time=(k+i)rotations\ of\ the\ platen} \text{ and } \frac{\partial F_{ref}(\text{time})}{\partial \text{time}}\Big|_{time=(k+i)rotations\ of\ the\ platen}$$

for the controlled zone and for the reference zone, respectively.

Optionally, the measured thickness can be calculated based on the fitted functions. For example, the measured thickness of the $(k+i)^{th}$ rotation is $F_{control}$(t=(k+i) rotation of the platen) or $F_{ref}$(t=(k+i) rotation of the platen) for the controlled zone or the reference zone. However, although the measured polishing rates are determined based on the fitted function, the measured thicknesses do not have to be determined based on the fitted function. Instead, as discussed above, they can be determined as the average or median value of the derived thicknesses in the corresponding rotation of the platen.

In the example shown in FIG. 4A, a first-order function, i.e., a line 400, 402, is fit to each set of thickness data for each zone. The slopes of the lines 400, 402 represent constant polishing rates $r_{control}$ and $r_{ref}$ for the controlled zone and the reference zone, respectively, during the time period $t_0$-$t_1$. The thickness value of the two lines 400, 402 at each time point corresponding to the k, . . . , or k+n rotation of the platen represents the measured thickness of the respective zones in the corresponding rotation. As an example, the measured thicknesses of the controlled zone and the reference zone at the k+n rotation of the platen are highlighted in an enlarged circle 404 and an enlarged square 406, respectively. Alternatively, the measured thicknesses for the n+1 rotations can be calculated independently of the lines 400, 402, e.g., as the average or the medium values of the derived thicknesses of the respective rotations.

Generally, any suitable fitting mechanisms can be used to determine the measured thicknesses and measured polishing rates in the multiple rotations between times $t_0$ and $t_1$. In some implementations, the fitting mechanism is chosen based on the noise in the derived thicknesses, which may originate from the noise in the measurement, in the data processing and/or operation of the polishing apparatus. As an example, when the derived thicknesses contain a relatively large amount of noise, the least square fit can be chosen to determine the measured polishing rates and/or the measured thicknesses; when the derived thicknesses contain a relatively small amount of noise, the polynomial fit can be chosen.

For subsequent time periods, e.g., $t_1$-$t_2$, $t_2$-$t_3$, etc., derived thicknesses of the controlled zone and the reference zone can be calculated using thickness values accumulated in that time period, possibly in conjunction with thickness values from one or more prior time periods.

In some implementations, the technique to calculate the measured "polishing rate" can be selected by user input from an operator of the polishing apparatus through a graphical user interface, e.g., a radio button.

Figure 5:
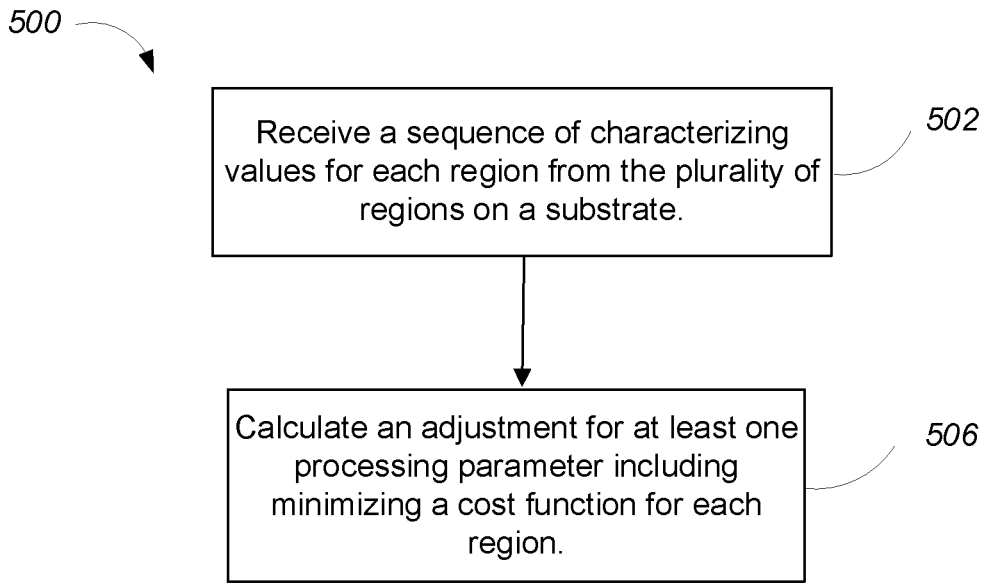
FIG. 5 is a flow diagram of a method of generating a desired substrate profile.

Desired Polishing Rates Based on the Measured Thicknesses and Measured Polishing Rates Based on the measured thicknesses and measured polishing rates of each zone including changes in control inputs, a projected thicknesses can be determined for the time period from $t_1$ to $t_n$. An example process 500 is shown in FIG. 5, in connection with the example data shown in FIGS. 4A-4B. The controller receives state information of the substrate (e.g., thicknesses and polishing rate of each zone). The controller can also store the desired polishing profile, as well as a recipe that sets desired polishing parameters, e.g., a desired pressure for each zone.

The controller and/or the computer receives, from the in-situ monitoring system, a sequence of characterizing values (e.g., thicknesses) for each region on the substrate (502). An expected endpoint time or an expected thickness at an expected endpoint time can be calculated from the sequence of characterizing values. The expected endpoint time can be a preset time, or can be calculated by determining when the linear function fit to the data of the reference zone (shown by line 402) is equal to target thickness. The expected thickness for one or more zones, e.g., the controlled zone, can be determined by extending the fitted thickness function 402 to the endpoint. In the example shown in FIG. 4B, the line 400 is extended at the constant slope to endpoint time, and the expected thickness for the controlled zone is determined as the vertical value of the curve at that time.

The controller calculates an adjustment of at least one processing parameter (506) in order to achieve closer endpoint conditions. In particular, at least one polishing parameter can be adjusted such that the controlled zone reaches the target thickness at the same time as the reference zone. Calculating the adjustment of the at least one processing parameter includes minimizing a cost function that incorporates input from each region.

In some prior control algorithms, a desired polishing rate is calculated for the controlled zone under the assumption that the polishing rate will not thereafter be adjusted. For example, in FIG. 4B, the slope of the dashed line 410 represents a calculated desired polishing rate $r_{res}$ of a controlled zone to bring the controlled zone to the target thickness at the expected endpoint.

In contrast, in solving for the current adjustment for a polishing parameter, the present technique calculates all of the expected future polishing parameter changes under the cost function. This takes into account expected polishing rates at each pressure update time and future changes to the polishing parameters. For example, in FIG. 4B, the dotted line 412 represents a projection of the characterizing value over time that takes into account the expected future adjustments to the polishing parameters. This technique permits the target polishing profile to be achieved more consistently while avoiding other problems such as sudden pressure changes, pressure imbalance in the carrier head chambers, etc.

The processing parameters that are adjusted are typically the pressures in the chambers of the carrier head, although the technique is applicable to other parameters such as the platen rotation rate or carrier head rotation rate.

The variables in the cost function can include a difference between the current characterizing value and a target characterizing value for each region (or more generally, a difference between the current polishing profile and the target polishing profile), a difference between an expected characterizing value at the end of polish and the target characterizing value for each region, the magnitude of the changes in polishing parameters over time (e.g., the magnitude of the plurality of pressure changes over time) for one or more regions, the polishing rate in each zone, and/or a plurality of differences between projected future polishing parameters (e.g., pressures) over time and a baseline recipe of polishing parameters (e.g., pressures) over time for one or more regions.

A Preston matrix, i.e., a matrix that expresses the Preston relationship between applied pressure and polishing rate, is used to convert a normalized pressure change to normalized rate change. The units can be modified by multiplying the Preston matrix with a nominal polish rate. An inverted Preston matrix can be used to back-calculate a pressure change from a rate change.

The controller can further be subject to user specified constraints during the optimization. For example, the user can define a maximum allowed pressure change or minimum and maximum absolute pressures. If current zone pressures are represented by p and applied pressure changes are represented by u, the constraints can be represented as following:

$$|u_k| \leq \Delta p_k^{max} \text{(Maximum Step Change Limit)}$$

$$u_k + p_k \leq \Delta p_k^{max} \text{(Maximum Absolute Pressure)}$$

$$u_k + p_k \geq \Delta p_k^{min} \text{(Minimum Absolute Pressure)}$$

In addition, the retaining ring (RR) pressure is calculated to serve as a reference pressure to maintain RR ratio or output pressure as defined by the user. In some implementations the calculated RR pressure is applied after a delay of 500 ms. For example, when the RR pressure is higher (or membrane pressure if RR is lower), the pressure change adjustment will not be applied by the controller if the RR ratio constraints are not satisfied.

However, adjusting of the processing parameters is done in order to reach several objectives. Objective can include one or more of reaching the target thickness in each zone at the expected endpoint, applying small pressure changes without deviating far from the baseline pressure, reducing deviation of the pressures from a preset pressure recipe, and reducing deviation of the pressures from an average pressure across the carrier head.

The objectives can be realized by defining a cost function that includes a term for each objective. The cost function is defined in terms of control inputs (u), e.g., the polishing parameters to be calculated, and a state (x). Example of matrices for the control inputs (u) and the state (x) are shown below.

As an example, the cost function includes a term that has, for each region, a difference between a current characterizing value and a target characterizing value for the region. This can represent the objective of reaching the target thickness in each zone at the expected endpoint.

As another example, the cost function includes a term that has, for each region, the plurality of a projected future pressure changes over time for the region. This can represent the objective of applying small pressure changes without deviating far from the baseline pressure.

As another example, the cost function includes a term that has, for each region, the plurality of differences between projected future pressures over time and the baseline pressure for the region. This can represent the objective of reducing deviation of the pressures from a preset pressure recipe.

As another example, the cost function can includes a term that has, for each region, a difference between the pressure of the region and an average pressure in the carrier head. This can represent the objective of reducing deviation of the pressures from an average pressure across the carrier head.

In some implementations, the control input column vector (u) includes N pressure changes corresponding to the zones $Z_1, \ldots, ZN$, and the state column vector (x) includes both a different between the current thickness for each zone and the target thickness for the zone (e.g., $Z_1$ thickness-$Z_1$ target thickness), the polishing rate in each zone, and the difference between the current pressure for a zone and the baseline pressure, e.g., the pressure from the recipe (e.g., $Z_1$ pressure-$Z_1$ baseline pressure).

$$x \equiv \begin{bmatrix} Z_1\text{Thickness} - Z_1\text{Target Thickness} \\ \vdots \\ Z_N\text{Thickness} - Z_N\text{Target Thickness} \\ Z_1\text{Rate} \\ \vdots \\ Z_N\text{Rate} \\ Z_1\text{Pressure} - Z_1\text{Baseline Pressure} \\ \vdots \\ Z_N\text{Pressure} - Z_N\text{Baseline Pressure} \end{bmatrix}$$

$$u \equiv \begin{bmatrix} Z_1\text{Pressure Change} \\ \vdots \\ Z_N\text{Pressure Change} \end{bmatrix}$$

In order for each zone to reach its target when the cost function is minimized, one or more of the terms in the state may be defined as offsets. For example, for a zone to reach a target thickness the cost function is a function of a square of each difference between the current characterizing value and the target characterizing value for the region. For example, for a zone to reach a target pressure the cost function is a function of a square of each projected future pressure change, and a square of each difference between the projected future pressure and the baseline pressure.

Further, the cost function can differently weight the various objectives.

For example, the cost function can include a first constant for each region. The cost function can include a function of the first constant multiplied by the square of the difference between the current characterizing value and the target characterizing value for the region.

In another example, the cost function includes a second constant for each region and the cost function is a function of the second constant multiplied by the square of each projected future pressure change.

In a third example, the cost function includes a quadratic function of the various rates, and the quadratic function is defined in a manner such that deviation of each zone's rate from the average rate of all the zones result in an increase of the cost function.

Matrix $Q_f$ below shows the weighing approach of parameters that may be important within the state at the end of polish. The parameters that are excluded are represented by 0 in the matrix. The terms resulting from $Q_f$ weighed inner product are presented with equation for variable $J_f$ that sums the terms and the resulting sum corresponds to the squared deviation from the target thickness for each zone.

$$Q_f \equiv \begin{bmatrix} Q_{ff} & 0 & 0 \\ 0 & 0 & 0 \\ 0 & 0 & 0 \end{bmatrix}$$

$$Q_{ff} \equiv \begin{bmatrix} f_1 & 0 & \ldots & 0 \\ 0 & \ddots & \ddots & \vdots \\ \vdots & \ddots & \ddots & 0 \\ 0 & \ldots & 0 & f_N \end{bmatrix}$$

$$J_f = x(T)^T Q_f x(T)$$

$$J_f = f_1 x_1^2 + \ldots + f_N x_N^2 \text{ at } \tau = T$$

The evolution of the control inputs in manner that can avoid underdamped or overdamped behavior is represented by the total cost function as $$J = \sum_{\tau=0}^{\tau=T-1} x(\tau)^T Q(\tau) x(\tau) + u(\tau)^T R u(\tau) + x(T)^T Q_f x(T)$$

Constraints on state evolution are expressed by same equation that defines Kalman filter. Therefore, the state $x(\tau)$ is subject to evolution under the constraints of $$x(\tau+1) = Ax(\tau) + Bu(\tau)$$

where A and B are matrices with constant values or predefined time-varying values.

The controller computes values for $u(\tau)$ that minimize the above total cost function. The cost function can be optimized by a linear quadratic regulator (LQR) when combined a linear equation of state as described above. LQR is a feedback controller that allows operation of a dynamic system at a minimum cost.

Q and R can be determined based on the desired aggressiveness of the controller, with larger values of R typically corresponding to less aggressive control and larger values in Q typically corresponding to more aggressive control.

The above cost function also sets the values of $Q_f$ based on a fraction of the removal rate amount. For example, the term containing the values of $Q_f$ remains relatively large to prevent the stage costs from dominating.

The cost function also may also be subject to inter-zone constraints, or constraints on average pressure by integrating them in the similar manner we followed above for each zone.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Although the description above has focused on control of a chemical mechanical polishing system, the techniques for determining an adjustment for a processing parameter can be applicable to other types of substrate processing systems, e.g., etching or deposition systems.

Embodiments, such as the filtering processes, of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. Alternatively or in addition, the program instructions can be encoded on an artificially generated propagated signal, e.g., a computer-generated electrical, optical, or electromagnetic signal, that is generated to encode information for transmission to suitable receiver apparatus for execution by a data processing apparatus. The computer storage medium can be a computer-readable storage device, a computer-readable storage substrate, a random or serial access memory device, or a combination of one or more of them.

The term "data processing apparatus" refers to data processing hardware and encompasses all kinds of apparatus, devices, and machines for processing data, including by way of example a programmable digital processor, a digital computer, or multiple digital processors or computers. The apparatus can also be or further include special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a stand alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit). For a system of one or more computers to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Control of the various systems and processes described in this specification, or portions of them, can be implemented in a computer program product that includes instructions that are stored on one or more non-transitory computer-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

Other embodiments are within the scope of the following claims.

What is claimed is:

1. A computer program product for controlling a polishing system, the computer program product residing on a non-transitory computer readable medium, the computer program product comprising instructions for causing one or more computers to:

receive from an in-situ monitoring system, for each region of a plurality of regions on a substrate being processed by the polishing system, a sequence of characterizing values for the region;

for each region, determine a polishing rate for the region; and calculate an adjustment for at least one processing parameter, wherein calculation of the adjustment includes minimizing a cost function that includes, for each region, a difference between a current characterizing value or an expected characterizing value at an expected endpoint time and a target characterizing value for the region, and wherein optimization of the cost function is subject to at least one constraint.

2. The computer program product of claim 1, wherein optimization of the cost function is subject to at least one inter-zone constraint.

3. The computer program product of claim 2, wherein the inter-zone constraint comprises a maximum difference in a processing parameter between zones.

4. The computer program product of claim 3, wherein the inter-zone constraint comprises a maximum difference in a processing parameter between adjacent zones.

5. The computer program product of claim 4, wherein the inter-zone constraints comprise a maximum difference in pressure between adjacent zones.

6. The computer program product of claim 2, wherein the inter-zone constraint comprises a maximum difference of a pressure in a zone from an average pressure of multiple zones.

7. The computer program product of claim 1, wherein optimization of the cost function is subject to a parameter constraint.

8. The computer program product of claim 7, wherein the parameter constraint comprises a maximum or minimum parameter value.

9. The computer program product of claim 8, wherein the parameter constraint comprises a maximum pressure.

10. The computer program product of claim 1, wherein the at least one constraint comprises a linear inequality constraint.

11. The computer program product of claim 1, wherein each characterizing value of the sequence of characterizing values is a thickness.

12. The computer program product of claim 1, wherein the parameter is pressure of a chamber in a carrier head of the polishing system.

13. A polishing system, comprising:

a platen to support a polishing pad;

a carrier head to hold a substrate in contact with the polishing pad;

a motor to generate relative motion between the carrier head and the polishing pad;

an in-situ monitoring system to, for each region of a plurality of regions on the substrate being polished, generate a sequence of characterizing values for the region; and a controller configured to receive from the in-situ monitoring system, for each region of a plurality of regions on the substrate, the sequence of characterizing values for the region, for each region, determine a polishing rate for the region, and calculate an adjustment for at least one processing parameter, wherein calculation of the adjustment includes minimizing a cost function that includes, for each region, a difference between a current characterizing value or an expected characterizing value at an expected endpoint time and a target characterizing value for the region, and wherein optimization of the cost function is subject to at least one constraint.

14. The system of claim 13, wherein optimization of the cost function is subject to at least one inter-zone constraint.

15. The system of claim 14, wherein the inter-zone constraint comprises a maximum difference in a processing parameter between zones.

16. The system of claim 14, wherein the inter-zone constraint comprises a maximum difference of a pressure in a zone from an average pressure of multiple zones.

17. The system of claim 13, wherein optimization of the cost function is subject to a parameter constraint.

18. The system of claim 17, wherein the parameter constraint comprises a maximum or minimum parameter value.

19. A method for controlling a polishing system, the method comprising:

receiving from an in-situ monitoring system, for each region of a plurality of regions on a substrate being processed by the polishing system, a sequence of characterizing values for the region;

for each region, determining a polishing rate for the region; and calculating an adjustment for at least one processing parameter, wherein calculating the adjustment includes minimizing a cost function that includes, for each region, a difference between a current characterizing value or an expected characterizing value at an expected endpoint time and a target characterizing value for the region, and wherein optimization of the cost function is subject to at least one constraint.

20. A computer program product for controlling a semiconductor processing system, the computer program product residing on a non-transitory computer readable medium, the computer program product comprising instructions for causing one or more computers to:

receive from an in-situ monitoring system, for each region of a plurality of regions on a substrate being processed by a processing system, a sequence of characterizing values for the region;

for each region, determine a rate of change of the characterizing value for the region; and calculate an adjustment for at least one processing parameter, wherein calculation of the adjustment includes minimizing a cost function that includes, for each region, a difference between a current characterizing value or an expected characterizing value at an expected endpoint time and a target characterizing value for the region, and wherein optimization of the cost function is subject to at least one constraint.

* * * * *